US011959298B1

(12) United States Patent
Purvis, Jr.

(10) Patent No.: US 11,959,298 B1
(45) Date of Patent: Apr. 16, 2024

(54) MODULAR CANOPY APPARATUS

(71) Applicant: Jerry G. Purvis, Jr., Adel, GA (US)

(72) Inventor: Jerry G. Purvis, Jr., Adel, GA (US)

( * ) Notice: Subject to any disclaimer, the term of this patent is extended or adjusted under 35 U.S.C. 154(b) by 225 days.

(21) Appl. No.: 17/324,052

(22) Filed: May 18, 2021

Related U.S. Application Data

(60) Provisional application No. 63/026,254, filed on May 18, 2020.

(51) Int. Cl.

| | |
|---|---|
| ***E04H 15/04*** | (2006.01) |
| ***A45B 23/00*** | (2006.01) |
| ***E04H 15/48*** | (2006.01) |
| ***E04H 15/58*** | (2006.01) |
| *E04H 15/54* | (2006.01) |

(52) U.S. Cl.
CPC ..... *E04H 15/04* (2013.01); *A45B 23/00* (2013.01); *E04H 15/48* (2013.01); *E04H 15/58* (2013.01); *A45B 2023/0025* (2013.01); *A45B 2023/0031* (2013.01); *A45B 2023/0093* (2013.01); *E04H 15/54* (2013.01)

(58) Field of Classification Search
CPC ..... E04H 15/001; E04H 15/48; E04H 15/58; A45B 2023/0025; A45B 2023/0031; A45B 2023/0087; A45B 2023/0093
See application file for complete search history.

(56) References Cited

U.S. PATENT DOCUMENTS

| | | | | | |
|---|---|---|---|---|---|
| 1,593,431 | A * | 7/1926 | Buie | E04H 15/58 | 135/900 |
| 3,032,046 | A * | 5/1962 | Coonradt | B63B 17/02 | 114/361 |
| 3,221,756 | A * | 12/1965 | Rupright | E04H 15/58 | 135/147 |
| 3,383,127 | A * | 5/1968 | Grunfeld | F16B 7/00 | 135/96 |
| 4,008,730 | A * | 2/1977 | Keklak | E04H 15/04 | 52/63 |
| 4,284,095 | A * | 8/1981 | Norton | A45B 11/00 | 135/21 |
| 4,724,882 | A * | 2/1988 | Wang | E04H 15/58 | 211/195 |
| 5,579,797 | A * | 12/1996 | Rogers | A45B 23/00 | 135/96 |
| 5,730,281 | A * | 3/1998 | Powell | B65D 5/5028 | 206/443 |
| 6,068,008 | A * | 5/2000 | Caldwell | E04H 15/28 | 135/88.11 |
| 6,588,440 | B2 * | 7/2003 | Varnado | E04H 15/04 | 248/230.8 |
| 7,182,091 | B2 * | 2/2007 | Maddox | A01M 31/025 | 182/135 |
| 7,264,011 | B2 * | 9/2007 | Cohen | A45B 23/00 | 135/21 |
| 7,290,553 | B2 * | 11/2007 | Prevost | E04H 15/48 | 135/143 |

(Continued)

*Primary Examiner* — David R Dunn
*Assistant Examiner* — Danielle Jackson
(74) *Attorney, Agent, or Firm* — UB Greensfelder LLP

(57) ABSTRACT

A modular canopy device having rotatably adjustable canopy panels that rotatable substantially through a range of 180 degrees that is removably secured to a base support assembly including a cantilever support member. A canopy fabric is provided on the canopy panel frame members to provide shelter and concealment attributes.

15 Claims, 6 Drawing Sheets

(56) References Cited

U.S. PATENT DOCUMENTS

| | | | | |
|---|---|---|---|---|
| 7,431,041 | B2 * | 10/2008 | Wu | A45B 25/20 135/21 |
| 7,516,707 | B2 * | 4/2009 | Schrot | A01M 31/02 182/187 |
| 7,896,015 | B2 * | 3/2011 | Milano, Jr. | E04H 15/06 135/117 |
| 8,201,571 | B1 * | 6/2012 | Smith | E04H 15/04 135/117 |
| 8,360,083 | B2 * | 1/2013 | Anders, III | E04H 15/001 135/90 |
| 8,863,766 | B1 * | 10/2014 | Kent | E04H 15/04 182/135 |
| 9,945,148 | B1 * | 4/2018 | Schell | E04H 15/06 |
| 2002/0036007 | A1 * | 3/2002 | Sellers | E04H 15/04 135/21 |
| 2011/0108076 | A1 * | 5/2011 | Connot | E04H 15/06 135/88.05 |

* cited by examiner

MODULAR CANOPY APPARATUS

CROSS-REFERENCE TO RELATED APPLICATIONS

This application claims the benefit of U.S. provisional patent application No. 63/026,254 filed 18 May 2020, the disclosure of which is hereby incorporated by reference.

TECHNICAL FIELD

Exemplary embodiments of the present invention relate generally to mechanical devices and more specifically to portable structures offering cover and protection from the elements.

BACKGROUND OF THE INVENTION

It is known in the sporting industry to provide various devices for game hunters or nature enthusiasts to use for shelter or concealment when engaged in hunting or observation activity. Exemplary devices included tree stands, seating, covers, blinds and tents. It is common for game hunters, for instance, to affix one or more elevated stationary structures in which to position themselves during hunting activity. Generally referred to as tree stands, these structures are known in many forms ranging from simple platforms for standing or sitting to more elaborate contrivances exhibiting elements such as camouflage, seating, coverings and the like.

Hunters that use tree stands will often be positioned therein for long periods of time while waiting for the desired game to approach the area. Many of the stands used today do not provide overhead cover for the hunter, thereby subjecting them to the elements such as rain, snow, wind and the like. Some hunters prefer the option of deploying a covering element depending on weather patterns and time of year, for instance, and therefore seek products that have separate supporting and covering elements. There is thus a need in the art for deployable covering devices for use in conjunction with tree stand devices, or as a standalone device.

Some of the known covering devices—including those integrated with supporting structures as well as standalone devices—provide a single, fixed orientation for the covering. These devices are considered disadvantageous because they are not adjustable to suit the location in which they are used or to account for changing circumstances such as sun positioning, wind direction, precipitation characteristics, temperature changes, game movement patterns and the like. In certain cases, this aspect of known devices can be particularly important when hunting highly visual game, wherein coverings are used to visually conceal the user.

Under circumstances in which one or more locations are frequented by a user, many known devices utilize laborious methods of affixing and removing the covering from the chosen tree or other similar elevated structure. It is therefore seen as advantageous for a covering device to be easy to setup and take down when needed. Current known devices also do not provide for methods of readily deploying at multiple locations having more longstanding securement methods.

It is also seen as advantageous for covering devices to be portable. Oftentimes hunting or observation stations are moved between various locations based on preference, weather, migratory patterns, and user preference, for example. It would therefore be desirable for a covering device to be readily transportable by simply manual carrying by a user.

It is therefore an unmet need in the prior art for an independent covering system that is readily deployable and portable and offers a variety of useful configurations to the user. No known references, taken alone or in combination, are seen as teaching or suggesting the presently claimed modular canopy apparatus.

BRIEF SUMMARY OF THE INVENTION

Exemplary embodiments of the present disclosure pertain to a modular canopy device useful for shelter and concealment by game hunters and nature enthusiasts. Embodiments include a base support assembly including a mounting plate and cantilever support, a support sleeve assembly removably attachable to the base support assembly, one or more canopy panel frame members rotatably secured within the support sleeve assembly, and at least one canopy fabric piece secured within the at least one canopy panel frame members.

An object of the present invention is to provide readily installable, transportable and storable shelter and concealment canopy devices.

An objection of the disclosure is to provide a canopy device for affixation to an environmental support having a means for temporarily securing the canopy device to the environmental support, a cantilever support fixed at a proximal end with respect to the environmental support, a first panel frame member rotatably fixed with respect to the cantilever support, a means for fixing the first panel frame member in an open position; and a canopy cover secured to the first panel frame member.

In some embodiments, the canopy device includes a second panel frame member rotatably fixed with the respect to the cantilever support and a means for fixing the second panel frame member in an open position, wherein the canopy cover is secured to the first panel frame member and the second panel frame member.

In some embodiments, the canopy device includes a canopy cover made of a water impermeable material and having a perimeter and a plurality of eyelets spaced evenly around the perimeter. The canopy cover is secured to the first and second panel frame members with a length of cord looped through each eyelet in the plurality of eyelets and around the first and second panel frame members.

The canopy cover can further include a means for separating a first portion of the canopy cover from a second portion of the canopy cover. In some embodiments, this is provided as a zipper mechanism joining the first portion of the canopy cover to the second portion of the canopy cover.

In some embodiments, the means for temporarily securing the canopy device to the environmental support includes a mounting plate having a mounting aperture and a fastener passing through the mounting aperture and into the environmental support, whereby the canopy device is secured to the environmental support. In some embodiments, this is provided as a mounting plate having a mounting aperture and an adjustable strap passing through the mounting aperture to form a loop wherein the canopy device is secured to the environmental support by tightening the loop around the environmental support.

An exemplary embodiments of the device is provided that includes a mounting surface, a cantilever support fixed at a proximal end to the mounting surface, a support sleeve assembly having a primary support sleeve whereby the support sleeve assembly is removably attachable to the cantilever support, a first canopy panel support sleeve, and a second canopy panel support sleeve, a first panel frame member rotatably fixed within the first canopy panel support sleeve, a second panel frame rotatably fixed within the first canopy panel support sleeve, a means for fixing each of the first and second panel frame members in an open position, and a canopy cover secured to the first and second panel frame members.

In some embodiments, the canopy device includes a first set screw threaded through a first aperture within the first canopy panel support sleeve and a second set screw threaded through a second aperture within the second canopy panel support sleeve.

It is an object of this invention to provide a modular canopy device of the type generally described herein, being adapted for the purposes set forth herein, and overcoming disadvantages found in the prior art. These and other advantages are provided by the invention described and shown in more detail below.

BRIEF DESCRIPTION OF THE SEVERAL VIEWS OF THE DRAWINGS.

Novel features and advantages of the present invention, in addition to those mentioned above, will become apparent to those skilled in the art from a reading of the following detailed description in conjunction with the accompanying drawings wherein identical reference characters refer to identical parts and in which.

DETAILED DESCRIPTION OF THE INVENTION

Figure 1:
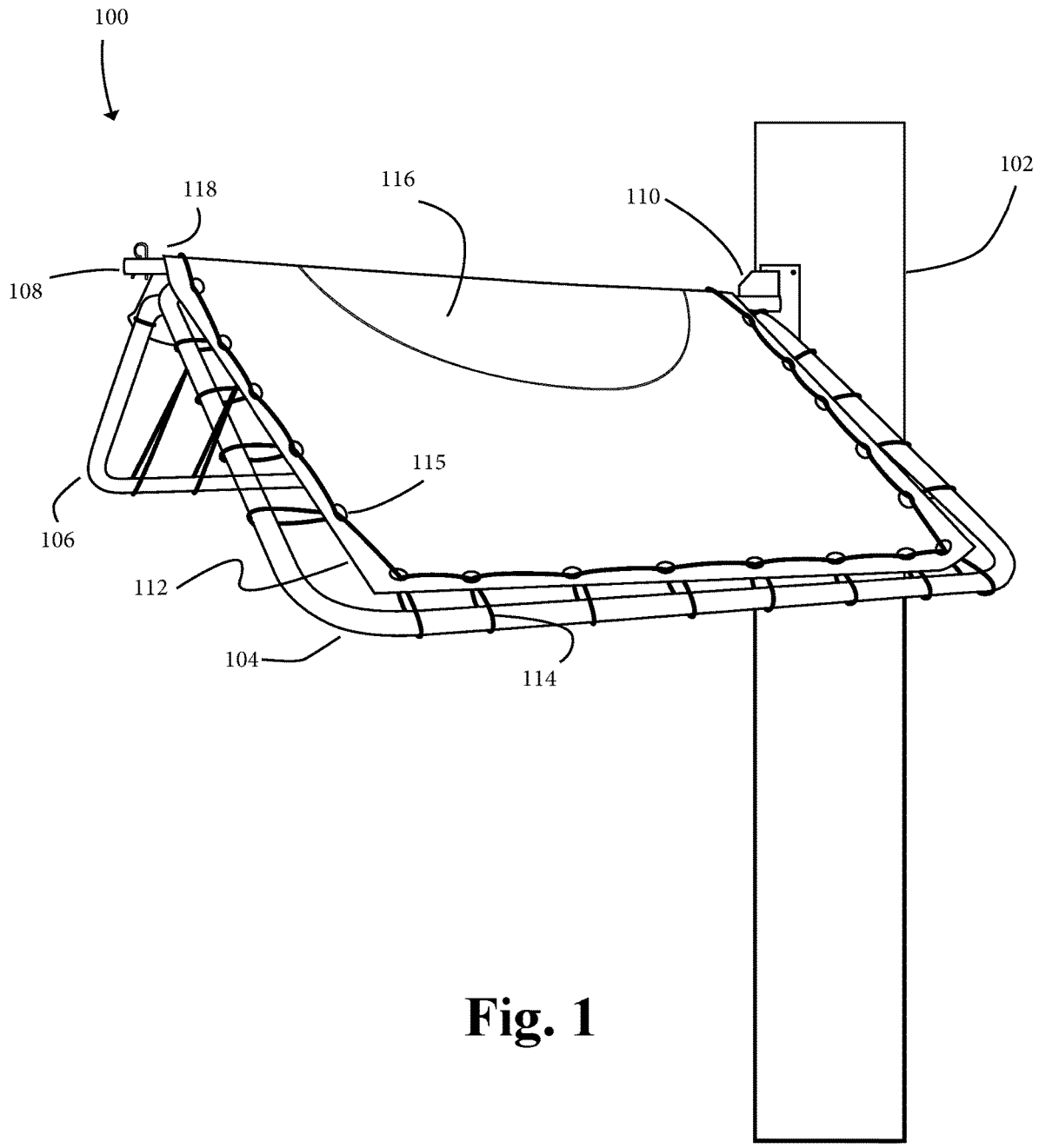
FIG. 1 is a perspective view of an exemplary canopy device in a deployed configuration.

Exemplary embodiments of the present invention are directed to modular canopy devices, such as the canopy device 100 shown in connection with FIG. 1. The canopy device 100 shown there is depicted in a deployed state, wherein it is affixed to a generally vertical stationary object or surface—in this case a tree trunk 102. While deployed, the canopy device 100 provides a user positioned beneath it with a sheltering cover that is securely affixed in the environment.

In some embodiments, the canopy device 100 is provided with one or more canopy panel frame members, as shown with first 104 and second 106 panel frame members in connection with FIG. 1. The first 104 and second 106 panel frame members are rotatably secured to a canopy cantilever support 108 that, when deployed, is fixed with respect to the environmental element (e.g., a tree trunk 102). In this embodiment, the cantilever support 108 is fixed to the tree trunk 102 via a mounting plate 110 and a plurality of screws (not shown). In some embodiments, the frame elements of the canopy device 100 are formed primarily of metal, and more specifically a combination of hollow metal tubing and sheet metal or metal plates. In other embodiments the parts may be formed of plastics, wood, or combinations of metal, plastic and wood as suitable for a particular application.

One or more pieces of canopy fabric are provided to cover a portion or all of the area defined by the canopy panel frame members. In the exemplary embodiment shown in connection with FIG. 1, a single canopy fabric 112 is stretched across the first 104 and second 106 canopy frame members and is secured thereon via a length of cordage 114. In a preferred embodiment, the canopy fabric is embodied in a material that is water impermeable and provides protection from wind and precipitation elements. In the exemplary embodiment shown in connection with FIG. 1, the canopy fabric is secured with cordage 114 threaded through eyelets and around the canopy frame members around the perimeter of the canopy fabric. This embodiment also provides a zipper opening 116 that the user may open or close for comfort or visibility purposes.

In some embodiment, the canopy fabric is alternatively secured by wrapping the edges around the canopy panel frame members and sewing the frame inside one or more pockets created in the canopy fabric, or other like methods of securing fabric to a frame, such as the use of VELCRO®, hook and loop, button snaps and the like. In some embodiments, the canopy fabric is provided as a camouflage print to increase the concealment of the user. Other embodiments include the securement elements along the edge of the canopy fabric, frame members, or a combination thereof, for holding devices such as but not limited to thermocells, flashlights, mosquito repellents, hunting equipment, water bottles, or additional camouflaged burlap or other such blind elements. For embodiments with eyelets, for instance, burlap or other concealing or insulating material can be attached around the perimeter of the frame.

Also shown in connection with FIG. 1 is a hitch pin 118 used to releasably secure the canopy panel assembly (including, e.g., the first 104 and second 106 canopy panel frame members and canopy fabric 112) to the cantilever support. As will be shown in greater detail below, the cantilever support 108 can be installed at a location on a more permanent basis, while the canopy panel assembly can be removed, folded and carried away more readily for mobility and storage purposes.

Figure 2:
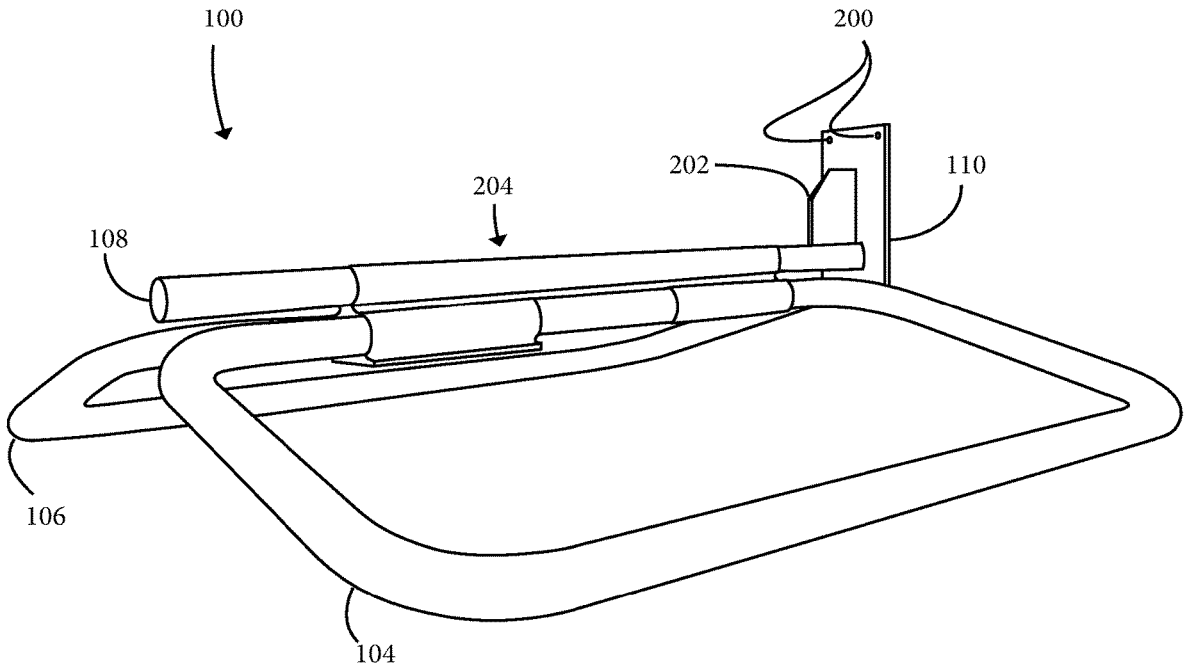
FIG. 2 is a further perspective view thereof.
Figure 3:
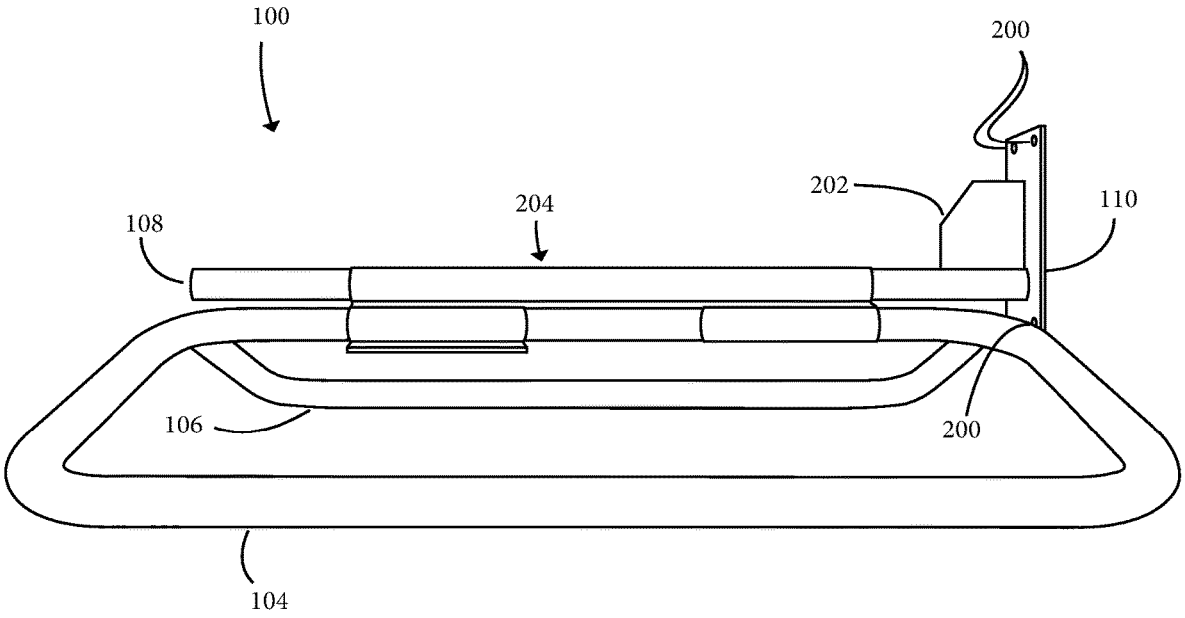
FIG. 3 is a side elevation view thereof.

Turning to FIG. 2 and FIG. 3, a perspective view and a side elevation view of the structural members of the first exemplary canopy device embodiment 100 are shown, respectively. The mounting plate 110 is shown embodied as a rectangular plate with a plurality of mounting apertures 200 located thereon for accepting mounting fasteners (not shown) to secure the device to a generally vertical surface such as a tree trunk. In some embodiments, the mounting plate 110 is connected to the cantilever support member 108 and may include one or more strength flanges 202 via welds or other like methods of permanent securement. Together, the mounting plate 110, cantilever support 108 and flange 202 generally form a base support unit. Users may utilize one or more base support units permanently secured at various locations. In the embodiment shown in connection with FIGS. 1-3, the user installs the base support units quickly and easily with a battery powered drill to drive screws directly into the tree trunk at the desired locations. Those skilled in the art will appreciate that there are other comparable known methods of affixing such devices to tree trunks, such as with ratchet straps affixed to the base and wrapped around the trunk, or the cantilever support itself can be fashion so as to be screwed directly into the tree trunk itself. These and other known methods may be employed without departing from the scope of the invention disclosed herein.

Figure 4:
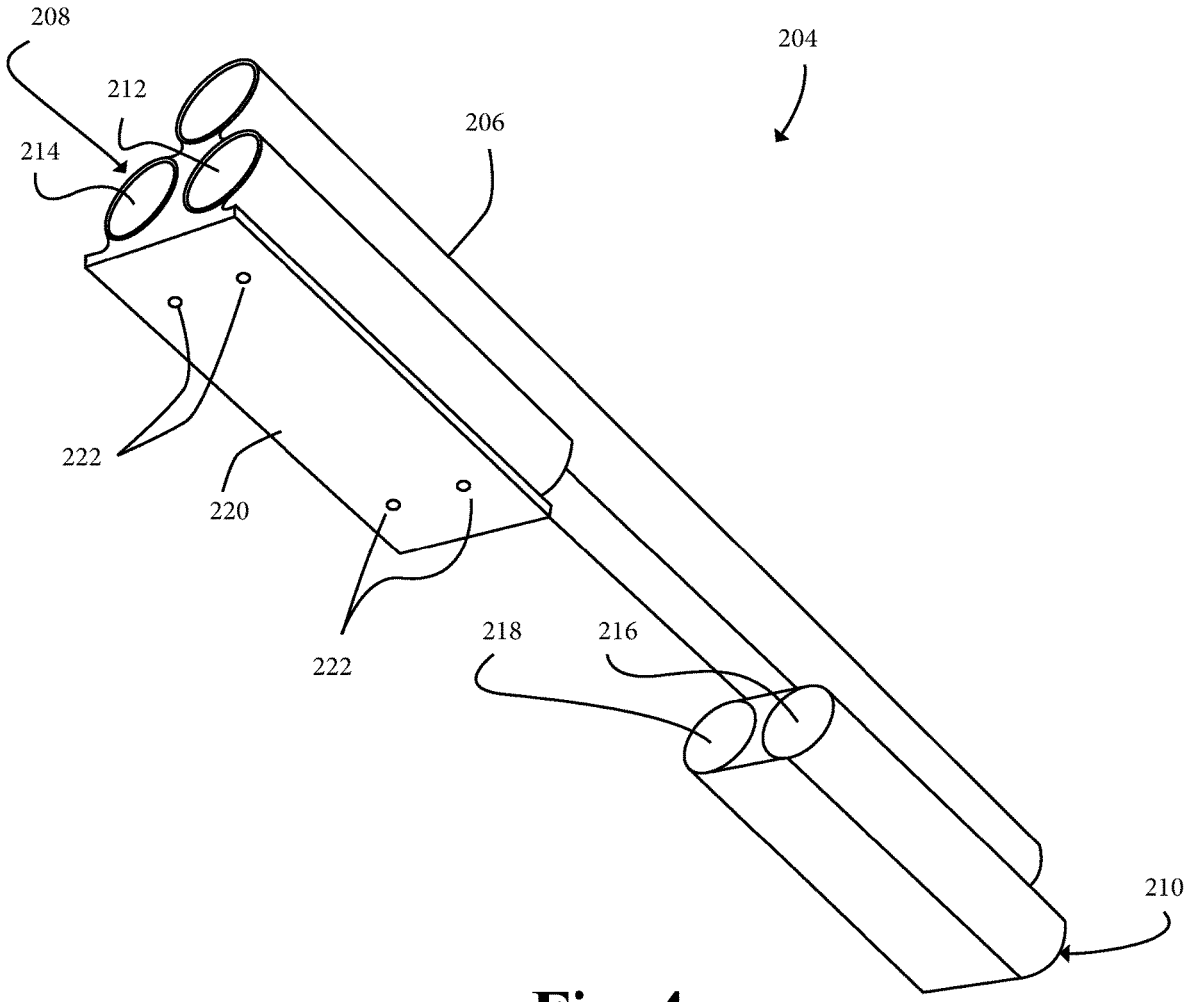
FIG. 4 is a perspective view of a support sleeve assembly element thereof.

Also shown in connection with FIGS. 2 and 3 is a support sleeve assembly 204, which generally embodies the means for securing the canopy panels to the base support unit. FIG. 4 is a perspective view that illustrates the support sleeve assembly 204 in isolation for greater detail. The support sleeve assembly 204 includes a primary support sleeve 206 and one or more canopy panel support sleeves. In this embodiment, the one or more canopy panel support sleeves are provided as a first canopy panel support 208 and a second canopy panel support 210. In turn, the first 208 and second 210 canopy panel supports each include a first and second canopy panel support sleeve, respectively (first 212 and second 214 sleeve form part of the first support 208 and first 216 and second 218 sleeve form part of the second support 210). In this embodiment, the first canopy panel frame member (see 104 in FIG. 2) is rotatably contained within the first canopy panel support sleeve 212 of the first canopy panel support 208 and the first canopy panel support sleeve 216 of the second canopy panel support 210. Likewise, the second canopy panel frame member (see 106 in FIG. 2) is rotatably contained within the second canopy panel support sleeve 214 of the first canopy panel support 208 and the second canopy panel support sleeve 218 of the second canopy panel support 210. In one embodiment, the various tubular sleeve members (e.g., 206, 212, 214, 216 and 218) are welded together to form the support sleeve assembly 204. However, other comparable or similar methods of manufacturing a part of adequate strength should be considered to form part of this disclosure herein.

In some embodiments, the support sleeve assembly 204 further includes one or more means for adjusting and fixing canopy panel positions. In the embodiment shown in connection with FIG. 4, the support sleeve assembly 204 includes an adjustment plate 220 welded onto the first canopy panel support 208 and a plurality of adjustment screw apertures 222 extending through said plate 220 and first 212 and second 214 canopy panel support sleeves. Manually operated set screws (not shown) are provided to be threaded through the apertures 222 and set the rotation orientation for each of the canopy panel frame members (e.g., 104 and 106 in FIG. 3). Those skilled in the art will understand that suitable alternatives may be substituted to provide for the adjustment of the canopy panel positions without departing from the scope of the invention described and claimed herein. For example, the canopy panel positions may be secured with spring-biased thumb pins, ratcheting systems, set screws and the like without limiting the scope herein.

Figure 5:
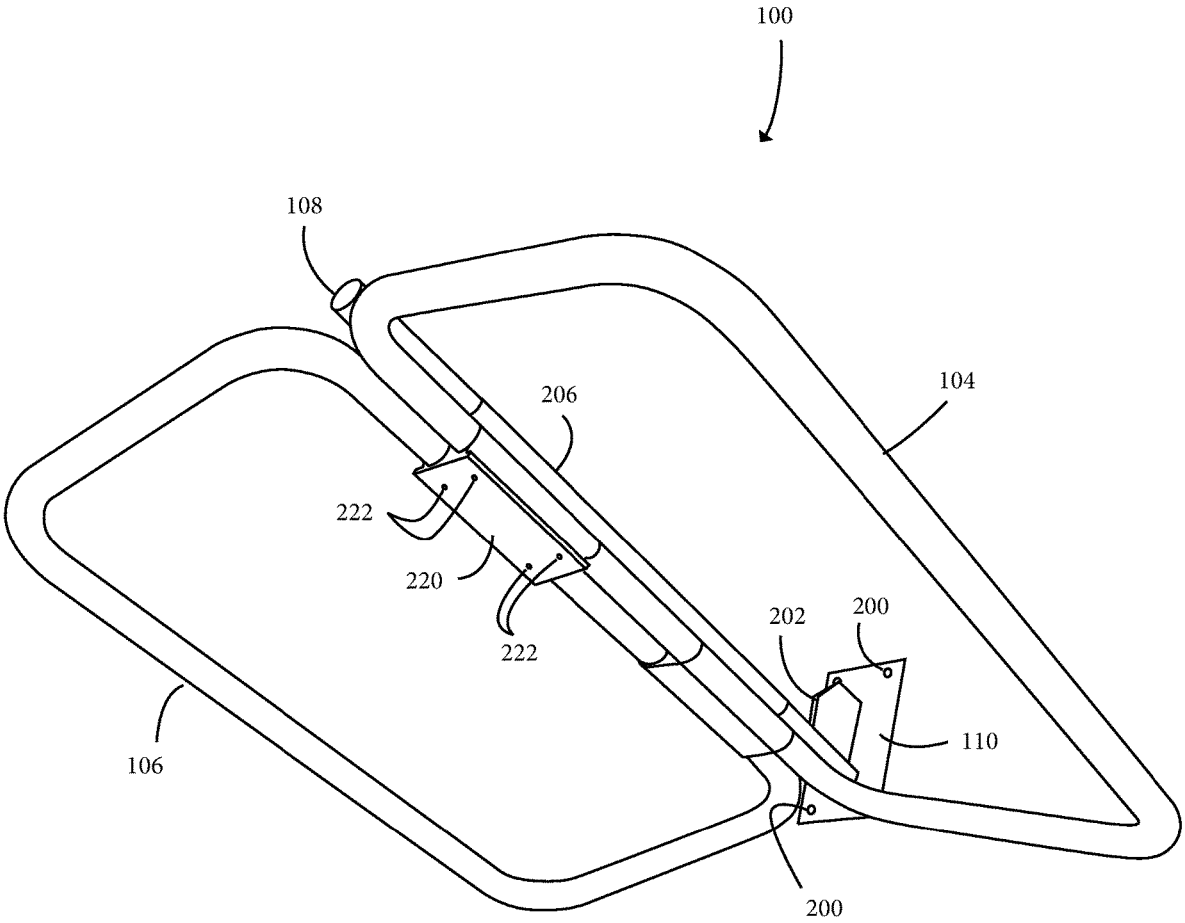
FIG. 5 is a further perspective view of the exemplary embodiment shown in connection with FIG. 1.

FIG. 5 is an additional perspective view of the exemplary canopy device embodiment 100 shown in connection with FIGS. 2-4. In this view, the plurality of adjustment screw apertures 222 and their positioning with respect to the first 104 and second 106 canopy panel frame members is illustrated. Similar elements are numbered to correspond with like parts to offer a more complete view of the embodiment.

Figure 6:
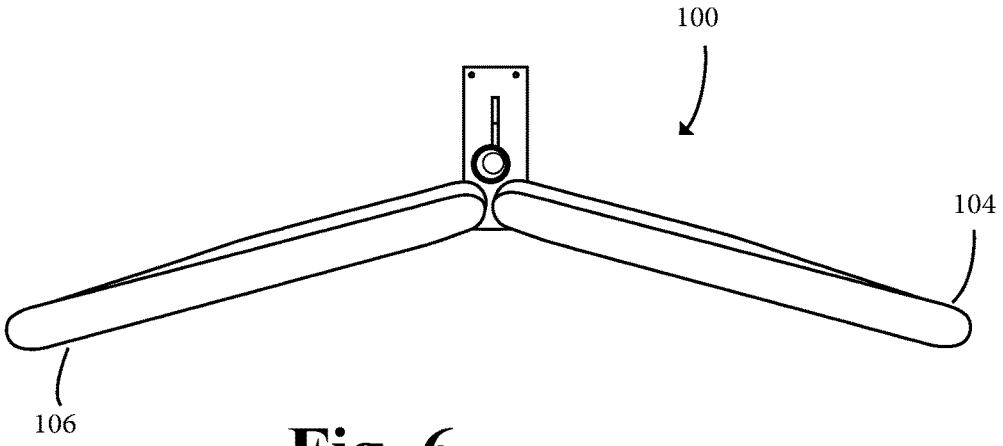
FIG. 6 is a view of a first exemplary canopy panel orientation thereof.

Next, a series of exemplary canopy panel frame member configurations are shown for the first 104 and second 106 canopy panel frame members of the exemplary canopy device embodiment 100. In FIG. 6, a standard open configuration is illustrated, wherein the first 104 and second 106 canopy panel frame members are rotatably fixed at or nearly 180 degrees relative to one another. In this position, the canopy device 100 is fully extended to provide maximum protection from above, for example to protect from precipitation.

Figure 7:
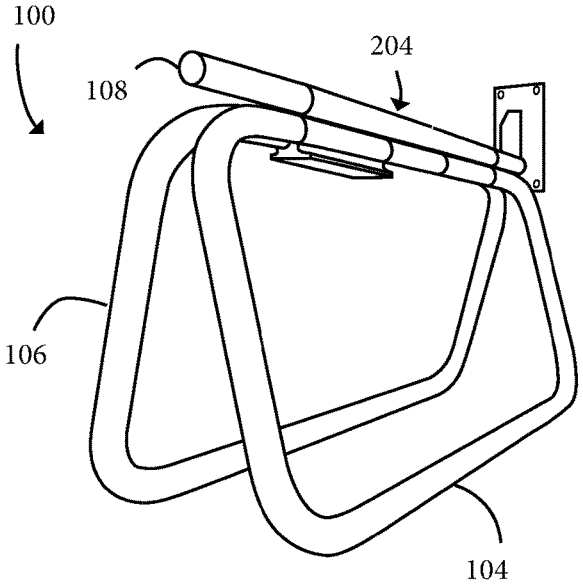
FIG. 7 is a view of a second exemplary canopy panel orientation thereof.

Turning to FIG. 7, a standard closed or folded configuration is illustrated, wherein the first 104 and second 106 canopy panel frame members are rotatably fixed at or nearly parallel to one another to facilitate transport or storage. This orientation allows for a flat, compact profile. The base support unit may be left in place if desired, and the support sleeve assembly 204 and canopy panel frame members 104 and 106 slid off of the cantilever support 108 to be carried away.

Figure 8:
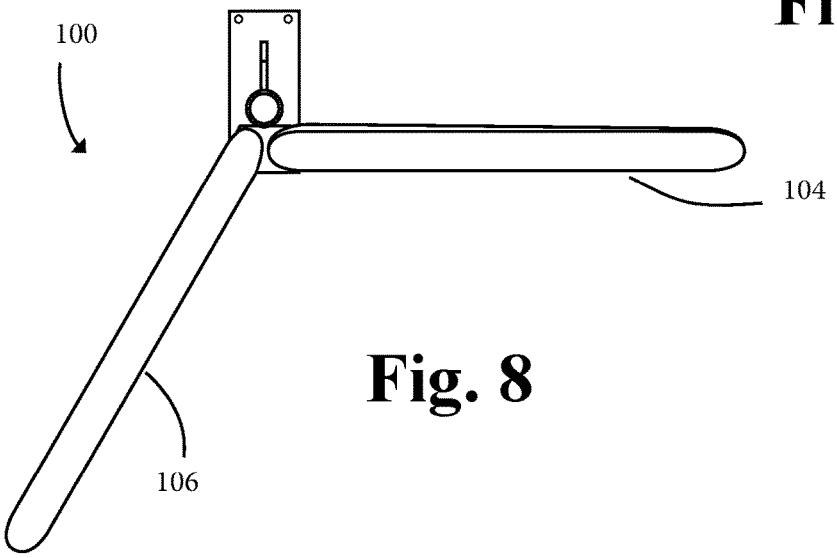
FIG. 8 is a view of a third exemplary canopy panel orientation thereof.

FIG. 8 illustrates an exemplary configuration wherein the first 104 and second 106 canopy panel frame members are rotatably fixed at a desirable angle suitable for a particular application, such as to conceal the user from one direction and to provide covering in the other. This orientation may be useful, for instance, with strong directional winds, or in circumstances in which the characteristics of a blind are desirable. FIG. 8 illustrates the versatility of the invented apparatus, in that it can be used both as a blind and portable tent or shelter simultaneously.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A canopy device for affixation to an environmental support comprising:

a means for temporarily securing the canopy device to the environmental support;

a cantilever support fixed at a proximal end with respect to the environmental support;

at least one support sleeve removably fixed to the cantilever support;

a first panel frame member rotatably contained within the at least one support sleeve;

a means for fixing the first panel frame member in an open position; and a canopy cover secured to the first panel frame member.

2. The canopy device of claim 1, further comprising:

a second panel frame member rotatably contained within the at least one support sleeve; and a means for fixing the second panel frame member in an open position, wherein the canopy cover is secured to the first panel frame member and the second panel frame member.

3. The canopy device of claim 2, wherein the canopy cover comprises a water impermeable material having a perimeter and a plurality of eyelets spaced evenly around the perimeter, and wherein the canopy cover is secured to the first and second panel frame members with a length of cord looped through each eyelet in the plurality of eyelets and around the first and second panel frame members.

4. The canopy device of claim 2, wherein the canopy cover further comprises a means for separating a first portion of the canopy cover from a second portion of the canopy cover.

5. The canopy device of claim 4, wherein the means for separating the first portion of the canopy cover from the second portion of the canopy cover further comprises a zipper mechanism joining the first portion of the canopy cover to the second portion of the canopy cover.

6. The canopy device of claim 2 wherein the means for temporarily securing the canopy device to the environmental support further comprises:

a mounting plate having a mounting aperture; and a fastener passing through the mounting aperture and into the environmental support whereby the canopy device is secured to the environmental support.

7. The canopy device of claim 2 wherein the means for temporarily securing the canopy device to the environmental support further comprises:

a mounting plate having a mounting aperture; and an adjustable strap passing through the mounting aperture to form a loop wherein the canopy device is secured to the environmental support by tightening the loop around the environmental support.

8. A canopy device for affixation to an environmental support comprising:

a mounting plate;

a cantilever support fixed at a proximal end to a mounting surface;

a support sleeve assembly comprising:

a primary support sleeve whereby the support sleeve assembly is removably attachable to the cantilever support;

a first canopy panel support sleeve; and a second canopy panel support sleeve;

a first panel frame member rotatably fixed within the first canopy panel support sleeve;

a second panel frame rotatably fixed within the second canopy panel support sleeve;

a means for fixing each of the first and second panel frame members in an open position; and a canopy cover secured to the first and second panel frame members.

9. The canopy device of claim 8, further comprising a means for securing the mounting plate to the environmental support.

10. The canopy device of claim 9 wherein the means for securing the mounting plate to the environmental support further comprises:

a mounting aperture in the mounting plate; and a fastener passing through the mounting aperture and into the environmental support whereby the canopy device is secured to the environmental support.

11. The canopy device of claim 9 wherein the means for securing the mounting plate to the environmental support further comprises:

a mounting aperture in the mounting plate; and an adjustable strap passing through the mounting aperture to form a loop wherein the canopy device is secured to the environmental support by tightening the loop around the environmental support.

12. The canopy device of claim 8, wherein the canopy cover comprises a water impermeable material having a perimeter and a plurality of eyelets spaced evenly around the perimeter, and wherein the canopy cover is secured to the first and second panel frame members with a length of cord looped through each eyelet in the plurality of eyelets and around the first and second panel frame members.

13. The canopy device of claim 8, wherein the canopy cover further comprises a means for separating a first portion of the canopy cover from a second portion of the canopy cover.

14. The canopy device of claim 13, wherein the means for separating the first portion of the canopy cover from the second portion of the canopy cover further comprises a zipper mechanism joining the first portion of the canopy cover to the second portion of the canopy cover.

15. The canopy device of claim 8 wherein the means for fixing each of the first and second panel frame members in an open position comprises:

a first set screw threaded through a first aperture within the first canopy panel support sleeve; and a second set screw threaded through a second aperture within the second canopy panel support sleeve.

* * * * *